US011389351B2

(12) United States Patent
Couture et al.

(10) Patent No.: US 11,389,351 B2
(45) Date of Patent: Jul. 19, 2022

(54) WHEELCHAIR FOOTREST ASSEMBLY

(71) Applicant: MOTION COMPOSITES INC., St-Roch-de-l'Achigan (CA)

(72) Inventors: Pierre-Andre Couture, Laval (CA); Maxime Lamarre, Terrebonne (CA); Gabriel Feron, Mascouche (CA); Michael Archambault, Saint-Roch-de-l'Achigan (CA)

(73) Assignee: MOTION COMPOSITES INC., St-Roch-de-l'Achigan (CA)

( * ) Notice: Subject to any disclaimer, the term of this patent is extended or adjusted under 35 U.S.C. 154(b) by 513 days.

(21) Appl. No.: 16/453,324

(22) Filed: Jun. 26, 2019

(65) Prior Publication Data

US 2020/0000660 A1 Jan. 2, 2020

Related U.S. Application Data

(60) Provisional application No. 62/690,463, filed on Jun. 27, 2018.

(51) Int. Cl.
*A61G 5/12* (2006.01)

(52) U.S. Cl.
CPC ..... *A61G 5/128* (2016.11); *A61G 2200/34* (2013.01)

(58) Field of Classification Search
CPC ..... A61G 5/128; A61G 2200/34; A61G 5/12; A61G 5/08; A61G 5/0808; A61G 5/0816; A61G 5/0825; B62B 7/06
See application file for complete search history.

(56) References Cited

U.S. PATENT DOCUMENTS 3,891,268 A * 6/1975 Taylor ..... A61G 5/1054 5/81.1 R
4,264,085 A * 4/1981 Volin ..... A61G 5/125 280/5.28
4,493,488 A * 1/1985 Panaia ..... A61G 7/05715 280/42
4,682,783 A * 7/1987 Kuschall ..... A61G 5/0816 280/250.1
4,917,395 A * 4/1990 Gabriele ..... A61G 5/0891 280/647
4,997,154 A * 3/1991 Little ..... A61G 5/0891 280/647

(Continued)

*Primary Examiner* — Minnah L Sech
*Assistant Examiner* — Conan D Duda
(74) *Attorney, Agent, or Firm* — Norton Rose Fulbright Canada LLP

(57) ABSTRACT

A footrest assembly for wheelchair of the type having a structure expandable from a contracted condition to an expanded position comprises a beam assembly having a structural member having a first end and a second end. A first joint one or more rotational degrees of freedom is adapted to interface the first end of the structural member to a first side of a frame of the wheelchair. A linkage assembly is connected to the structural member by a central joint with one or more rotational degrees of freedom and a lockable translational degree of freedom joint. A second joint with one or more rotational degrees of freedom is adapted to interface the linkage assembly to a second side of the frame of the wheelchair. A connector interface releasably engages the beam assembly to the linkage assembly and/or to the second joint when the wheelchair is deployed for use.

20 Claims, 6 Drawing Sheets

(56) References Cited

U.S. PATENT DOCUMENTS 5,101,536 A * 4/1992 Gabriele ..... A61G 5/128 280/42
5,127,709 A * 7/1992 Rubinstein ..... A61G 5/10 248/229.12
5,141,250 A * 8/1992 Morgan ..... A61G 5/128 280/42
5,186,480 A * 2/1993 Morgan ..... A61G 5/1083 280/250.1
5,273,304 A * 12/1993 Berkheimer ..... A61G 5/026 280/233
5,480,172 A * 1/1996 James ..... A61G 5/1097 280/250.1
5,568,933 A * 10/1996 Mizuno ..... A61G 5/0816 280/42
5,609,348 A * 3/1997 Galumbeck ..... A61G 5/1086 297/423.19
5,857,688 A * 1/1999 Swearingen ..... A61G 5/0883 280/42
5,904,398 A * 5/1999 Farricielli ..... A61G 5/0866 297/378.12
6,308,804 B1 * 10/2001 Roberts ..... A61G 5/101 188/31
6,460,933 B1 * 10/2002 Bors ..... A61G 5/1054 297/452.4
7,243,938 B2 * 7/2007 Stamps ..... A61G 5/1037 280/47.4
7,832,746 B2 * 11/2010 Peterson ..... B62H 1/12 280/30
8,191,913 B1 * 6/2012 Jessome ..... A61G 5/128 297/423.35
8,585,071 B2 * 11/2013 Golden, Jr. ..... A61G 5/1054 280/304.1
9,474,665 B1 * 10/2016 Chan ..... A61G 5/125
10,054,141 B2 * 8/2018 Guida ..... B62M 6/75
10,194,745 B2 * 2/2019 DuFresne ..... A47C 1/0246
10,299,875 B2 * 5/2019 Schoenig ..... F16M 11/42
10,517,780 B2 * 12/2019 Peskin ..... A61G 5/023
10,556,464 B2 * 2/2020 Vermeulen ..... B60B 1/0215
2006/0012146 A1 * 1/2006 Farnella ..... A61G 5/12 280/250.1
2006/0087103 A1 * 4/2006 Schreiber ..... A61G 5/0825 280/649
2007/0273124 A1 * 11/2007 Nishi ..... A61G 5/0883 280/250.1
2008/0238041 A1 * 10/2008 Chen ..... A61G 5/125 280/650
2010/0090437 A1 * 4/2010 Knopf ..... A61G 5/12 280/250.1
2013/0154231 A1 * 6/2013 Gabriely ..... A61G 5/0883 280/250.1
2014/0062060 A1 * 3/2014 Davison ..... A61G 5/12 280/304.1
2014/0252747 A1 * 9/2014 Hermes ..... A61G 5/12 297/440.14
2015/0272798 A1 * 10/2015 Hsieh ..... A61G 5/128 297/313
2018/0311087 A1 * 11/2018 Horacek ..... A61G 5/0825

* cited by examiner

WHEELCHAIR FOOTREST ASSEMBLY

CROSS-REFERENCE TO RELATED APPLICATION

The present application claims the priority of U.S. Patent Application No. 62/690,463, filed on Jun. 27, 2018 and incorporated herein by reference.

TECHNICAL FIELD

The present application relates to wheelchairs and, more particularly, to wheelchair footrest assemblies.

BACKGROUND OF THE ART

Wheelchairs have evolved over the years to become increasingly ergonomic, lightweight, easy to maneuver and to use. However, there remains room for improvement to add additional adjustment possibilities to wheelchairs, and to render them even more convenient to use, notably in the maneuverability, stiffness, balance, but also for moving into or out of the wheelchair, and folding or unfolding the wheelchair for storage.

For example, footplate assemblies, also known as footplate, footplate mechanism, footrest, among other possible names, must often be foldable if used in a foldable wheelchair. Some footplates and footrests are designed to extend from side to side, thereby adding rigidity to the front of the wheelchair. However, by adding a foldable footplate mechanism, the wheelchair has yet another mechanism that may add weight and oppose its forces against the folding and deployment of the chair. Moreover, the addition of another mechanism such as a footrest assembly to the wheelchair may complicate the assembly of the wheelchair due to the precise length of such mechanism to extend from side to side of the wheelchair.

SUMMARY

It is therefore an aim of the present disclosure to provide a wheelchair footrest assembly that addresses issues associated with the prior art.

Therefore, in accordance with a first embodiment of the present disclosure, there is provided a footrest assembly for wheelchair of the type having a structure expandable from a contracted condition to an expanded position, the footrest assembly comprising: a beam assembly having a structural member having a first end and a second end, a first joint with at least one rotational degree of freedom adapted to interface the first end of the structural member to a first side of a frame of the wheelchair, a linkage assembly connected to the structural member by a central joint with at least a rotational degree of freedom and a lockable translational degree of freedom joint, a second joint with at least one rotational degree of freedom adapted to interface the linkage assembly to a second side of the frame of the wheelchair, and a connector interface releasably engaging the beam assembly to the linkage assembly and/or to the second joint when the wheelchair is deployed for use.

Further in accordance with the first embodiment, a rotational axis of the central joint is for instance higher than a rotational axis of the first joint and of the second joint relative to a ground when the wheelchair is deployed for use.

Still further in accordance with the first embodiment, projections on a horizontal plane of the rotational axis of each of the first joint, the central joint and the second joint are for instance parallel to one another.

Still further in accordance with the first embodiment, the connector interface includes for instance a hook unit at or adjacent to the second end of the structural member.

Still further in accordance with the first embodiment, the structural member is for instance a tube, and the hook unit has for instance a quill and wedge assembly to be secured inside the second end of the tube.

Still further in accordance with the first embodiment, the first joint is for instance part of a pivot clamp unit having a clamp configured to be connected to the first side of the frame of the wheelchair.

Still further in accordance with the first embodiment, the clamp forms for instance a cylindrical joint with the first side of the frame.

Still further in accordance with the first embodiment, the second joint is for instance part of a mating clamp unit having a clamp configured to be connected to the second side of the frame of the wheelchair.

Still further in accordance with the first embodiment, the clamp forms for instance a cylindrical joint with the second side of the frame.

Still further in accordance with the first embodiment, the mating clamp unit has for instance a male member of the connector interface, for mating engagement with a female member of the connector interface on the structural member.

Still further in accordance with the first embodiment, the central joint is for instance part of a carriage clamp connected to the structural member.

Still further in accordance with the first embodiment, the carriage clamp forms for instance a cylindrical joint with the structural member, the cylindrical joint including the lockable translational degree of freedom joint and a lockable rotational degree of freedom joint about a longitudinal axis of the structural member.

Still further in accordance with the first embodiment, the beam assembly includes for instance a footplate.

Still further in accordance with the first embodiment, the footplate is for instance connected to the structural member by at least one clamp forming a lockable cylindrical joint with the structural member.

In accordance with a second embodiment of the present disclosure, there is provided a footrest assembly for wheelchair of the type having a structure expandable from a contracted condition to an expanded position, the footrest assembly comprising: a beam assembly having a structural member having a first end and a second end, a pivot clamp unit including a first joint with at least one rotational degree of freedom adapted to interface the first end of the structural member to a first side of a frame of the wheelchair, and a first clamp forming a cylindrical joint with the first side of the frame, a linkage assembly connected to the structural member by a central joint with at least a rotational degree of freedom, a mating clamp unit including a second joint with at least one rotational degree of freedom adapted to interface the linkage assembly to a second side of the frame of the wheelchair, and a second clamp forming a cylindrical joint with the second side of the frame, and a connector interface releasably engaging the beam assembly to the linkage assembly and/or to the mating clamp unit when the wheelchair is deployed for use.

Further in accordance with the second embodiment, a rotational axis of the central joint is for instance higher than a rotational axis of the first joint and of the second joint relative to a ground when the wheelchair is deployed for use.

Still further in accordance with the second embodiment, projections on a horizontal plane of the rotational axis of each of the first joint, the central joint and the second joint are for instance parallel to one another.

Still further in accordance with the second embodiment, the connector interface includes for instance a hook unit at or adjacent to the second end of the structural member.

Still further in accordance with the second embodiment, the structural member is for instance a tube, and the hook unit has for instance a quill and wedge assembly to be secured inside the second end of the tube.

Still further in accordance with the second embodiment, the mating clamp unit has for instance a male member of the connector interface, for mating engagement with a female member of the hook unit.

Still further in accordance with the second embodiment, the central joint is for instance part of a carriage clamp connected to the structural member.

Still further in accordance with the second embodiment, the carriage clamp forms for instance a cylindrical joint with the structural member, the cylindrical joint including the lockable translational degree of freedom joint and a lockable rotational degree of freedom joint about a longitudinal axis of the structural member.

Still further in accordance with the second embodiment, the beam assembly includes for instance a footplate.

Still further in accordance with the second embodiment, the footplate is for instance connected to the structural member by at least one clamp forming a lockable cylindrical joint with the structural member.

DETAILED DESCRIPTION

Figure 1:
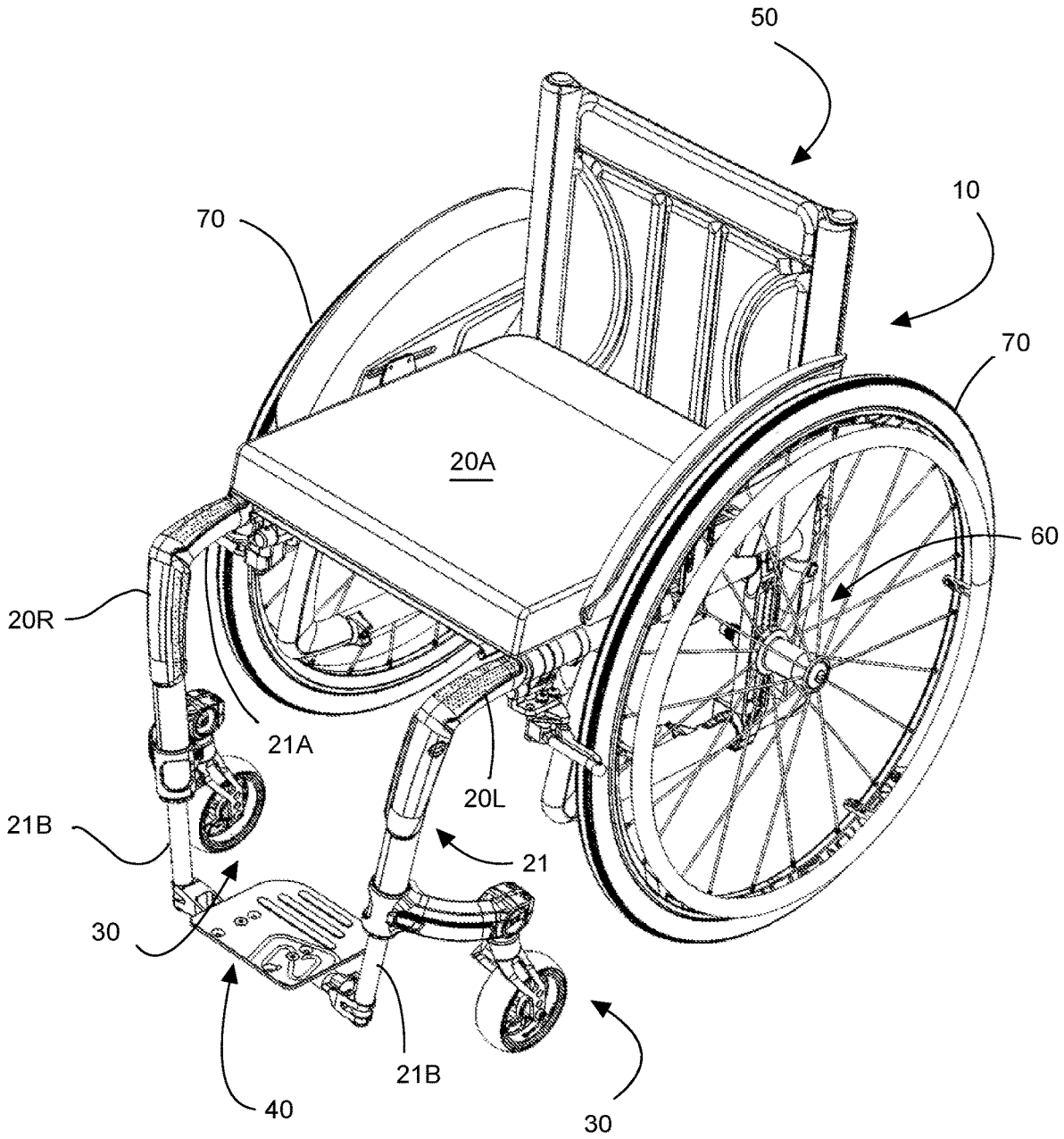
FIG. 1 is a perspective view of a wheelchair with a footrest assembly in accordance with the present disclosure.

Referring to the drawings and more particularly to FIG. 1, there is illustrated a wheelchair assembly at 10, also simply referred to as wheelchair. The wheelchair assembly 10 is of the type having a plurality of other components, including a seat frame 20, a pair of front caster assemblies 30, a footrest assembly 40, a backrest frame 50, bracket assemblies 60 and rear wheel units 70.

The seat frame 20 forms the structure of the wheelchair assembly 10, and forms a structure for a seat 20A to be supported by the seat frame 20. The seat frame 20 may have a pair of tube assemblies 21, a right-side tube assembly and a left-side tube assembly, for instance mirror images of one another. The seat frame 20 can be made of other components, i.e., not necessarily tubes, such as plates, beams, etc. The tube assemblies 21 are shown as having a L-shape. The L-shape is one possible embodiment of the tube assemblies 21, and other shapes include a generally polygonal shape, a U-shape, etc. Although the expression "L-shape" is used, the tube assemblies 21 may appear to be a L rotated by 90 degrees clockwise or counterclockwise, depending on the point of view of the observer of the wheelchair 10 of FIG. 1. Moreover, although a right-angle bend is shown in FIG. 1, other angles may be used.

The tube assemblies 21 may each include a tubular member made in any appropriate material, such as carbon fiber, composites, metals (e.g., aluminum, titanium, steel, etc), and combinations thereof. According to an embodiment, the tubular member is a monolithic tube. The tubular member may have a first portion 21A and a second portion 21B. The first portion 21A is generally horizontal when the wheelchair 10 is on its wheels, as in FIG. 1. The expression "generally horizontal" is well depicted in FIG. 1, in that the first portion 21A may or may not be substantially parallel to the ground, e.g., it may be at an angle of up to 20 degrees relative to the ground. It is observed that the first portion 21A is in the seating zone of the wheelchair 10, and may even support a seat of the wheelchair 10, as described hereinafter. The first portion 21A may also support the bracket assemblies 60 and the rear wheel units 70. The second portion 21B is generally vertical or generally upright when the wheelchair 10 is on its wheels, as in FIG. 1. The expression "generally vertical" is also well depicted in FIG. 1, in that the second portion 21B may or may not be substantially perpendicular to the ground. The second portion 21B is in the bottom front zone of the wheelchair 10, and may even support the front caster assemblies 30 and the footrest assembly 40, as described hereinafter. The sectional shape of the second portion 21B may be circular as in FIG. 1. The second portions 21B may be parallel to one another, but may also be in a non-parallel relation. For example, the second portions 21B may converge toward one another in a downward direction.

The backrest frame 50, bracket assemblies 60 and rear wheel units 70 are connected to the seat frame 20 in any appropriate manner. Moreover, these components often include mechanisms so as to be foldable or removable from the seat frame 20, for stowing the wheelchair 10. It is pointed out that the backrest frame 50, bracket assemblies 60 and rear wheel units 70 can have any appropriate configuration, beyond the configuration shown in the figures. For example, the seat frame 20, the front caster assemblies 30, the backrest frame 50, the bracket assemblies 60 and/or the rear wheel units 70 may be as in any of U.S. Pat. Nos. 8,628,108, 9,844,479, U.S. patent application Ser. No. 15/811,073, U.S. Pat. No. 10,123,922, U.S. patent application Ser. No. 16/081,459, U.S. Pat. No. 10,155,414, and/or US patent application Ser. No. 16/081,315.

Figure 2:
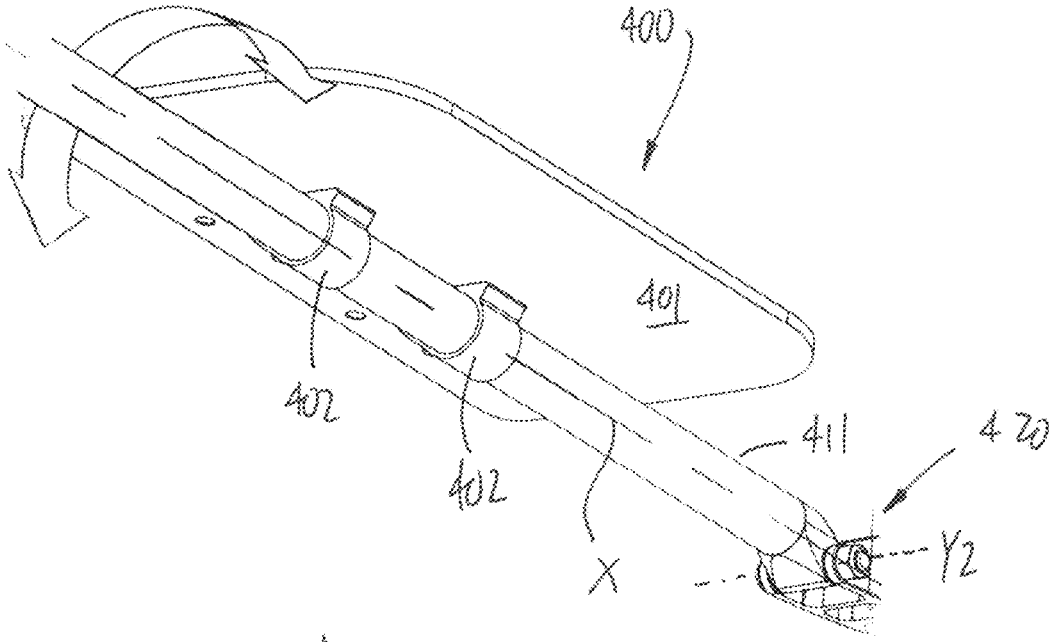
FIG. 2 is an underside perspective view of a footplate on a beam assembly in the footrest assembly of the present disclosure.
Figure 3:
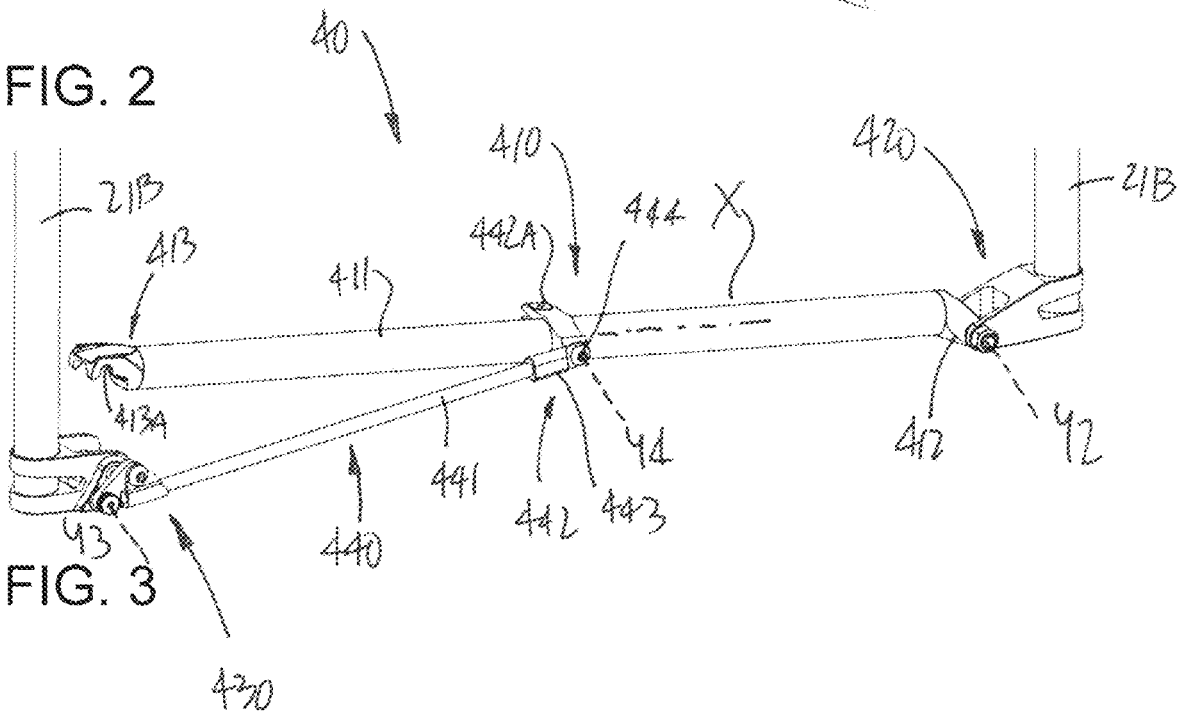
FIG. 3 is a perspective view of the footrest assembly of the present disclosure.

Referring to FIGS. 2 and 3, the footrest assembly 40 is shown in greater detail. Although the expression "footrest assembly" is used, other expressions may be used to identify the assembly, including footrest, footrest system, footrest unit, footrest mechanism, for example. Moreover, the expression "footplate" and "footrest" may be used interchangeably. The footrest assembly 40 may have a footplate 400, a beam assembly 410, a pivot clamp unit 420, a mating clamp unit 430, and/or a linkage assembly 440:

The footplate 400 is the part of the footrest assembly 40 upon which the user of the wheelchair 10 lays his/her feet. It is the interface between the user's feet and the wheelchair 10.

The beam assembly 410 is one of the structural components of the footrest assembly 40, and extends from side to side of the wheelchair 10. Accordingly, the beam assembly 410 provides stiffness to the wheelchair 10, especially when connected at opposed ends to the seat frame 20, or other frame member of the wheelchair 10. Moreover, the beam assembly 410 supports the footplate 400. Although not shown, the beam assembly 410 and the footplate 400 may be integrated to one another, for instance by having plates integral with the beam assembly 410.

The pivot clamp unit 420 interfaces the beam assembly 410 to one of the tube assemblies 21, for instance. The pivot clamp unit 420 defines a rotational joint with the beam assembly 410 for the folding of the footrest assembly 40.

The mating clamp unit 430 interfaces the beam assembly 410 to the other one of the tube assemblies 21, when the wheelchair 10 is in a use condition (i.e., rolling condition, deployed condition, etc). The mating clamp unit 430 defines a releasable connector joint with the beam assembly 410 for allowing the folding of the footrest assembly 40, such that the beam assembly 410 is releasably clamped to the mating clamp unit 430.

The linkage assembly 440 is another one of the structural components of the footrest assembly 40, and extends from the mating clamp unit 430 to the beam assembly 410. The linkage assembly 440 assists in the folding of the footrest assembly 40 by interfacing the beam assembly 410 to the beam assembly 410 when the footrest assembly 40 is folded or in the process of being folded.

Referring to FIG. 2, the footplate 400 is shown in greater detail. The footplate 400 may have a plate member 401, with one or more clamps 402 on the underside of the plate member 401. A top side of the plate member 401 may be substantially planar, but may also have surface features like ribs, or added grip components, such as sandpaper like surface features, etc. Moreover, additional items such as foot straps may also be present. The clamps 402 may be of the type having a bore of adjustable size (e.g., by a set screw), the bore being for example of circular shape. Accordingly, if mounted on a cylindrical component of the beam assembly 410, such as beam member 411, a rotational and translational joint may be formed, allowing an adjustment of the position of the footplate 400 in a direction parallel to an elongated axis X of the beam member 411, and an adjustment of the orientation of the footplate 400 relative to the elongated axis X of the beam member 411. Once a desired position and orientation is reached, the clamp(s) 402 may be tightened (e.g., set screws) to lock the footplate 400 in position and orientation on the beam member 411.

The configuration of the footplate 400 in FIG. 2 is one of the numerous contemplated configurations. There may be one footplate 400 per foot or one footplate 400 for both feet. The footplate 400 may have a single clamp 402 or more than two clamps 402. The footplate 400 may be fixed directly to the beam assembly 410 without adjustment possibility, for example without any clamp 402, or with only one of the translational or rotational adjustment possibility, e.g., such as by way of cylindrical joint (a lockable cylindrical joint). The footplate 400 may be made of any appropriate material such as metal(s), composites and/or plastics, and may have additional components such as an anti-slip top surface, anti-slip adhesive, surface formations (e.g., ribs), etc.

Figure 4:
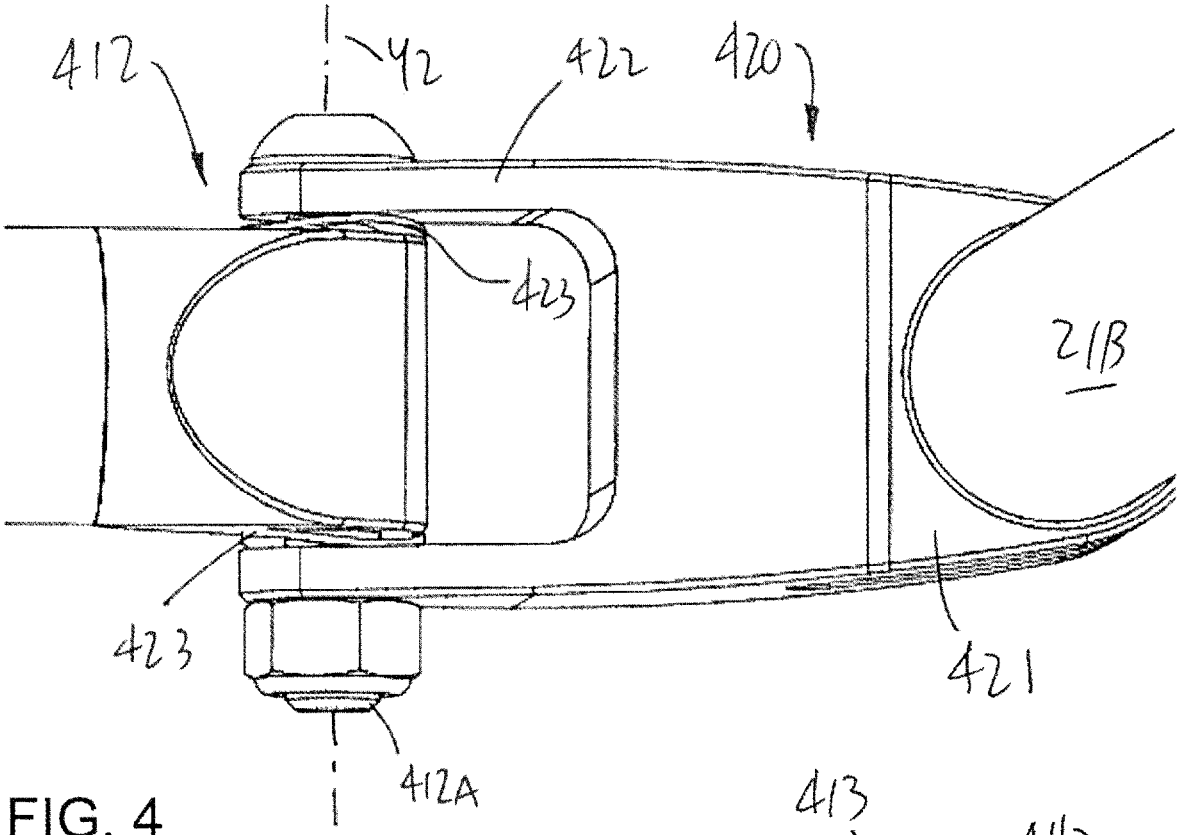
FIG. 4 is a top view of a joint between the beam assembly and a pivot clamp unit, in accordance with the present disclosure.

Referring to FIGS. 2 to 4, the beam assembly 410 is illustrated as having the beam member 411, or like elongated structural member with its elongated axis X. The beam member 411 may be a hollow tube of circular cross-section, although it may be solid (e.g., a rod), non-tubular, non-circular, etc. The beam member 411 may be made of any appropriate material such as metal(s), composites and/or plastics. In the illustrated embodiment, the beam member 411 is a tube, and the ends of the tube forming the beam member 411 may be open to accommodate connection components, such as those of a pivot unit 412 and of a connection interface such as a hook unit 413. According to an embodiment, a length of the beam member 411 is cut in plant as a function of the desired width of the wheelchair 10, and/or cut in situ to retrofit the footplate 400 on an existing wheelchair 10. The pivot unit 412 and the hook unit 413 may then be mounted to the opposed ends of the beam member 411.

The pivot unit 412 defines a support for pivot 412A shared with the pivot clamp unit 420. The pivot unit 412 may have an end press-fitted into the beam member 411 (e.g., force fit, interference fit, etc) or may be secured to the beam member 411 by a set screw, adhesive, among possibilities. As shown in FIG. 4, the pivot 412A may be a bolt and nut assembly as one of numerous possibilities. Other possibilities include a screw, a pin with lock washers, safety pins, etc. The pivot 412A has a rotational axis Y2. As observed in FIG. 3, the pivot unit 412 has an end projecting out of the beam member 411 that dips downwardly. Consequently, as shown in FIG. 3, the axis Y2 is below the axis X when the wheelchair 10 has its wheels to the ground (i.e., as in the orientation shown in FIG. 3). Stated differently, the axes X and Y2 are in a transverse relation, with the axis Y2 below axis X.

Figure 5:
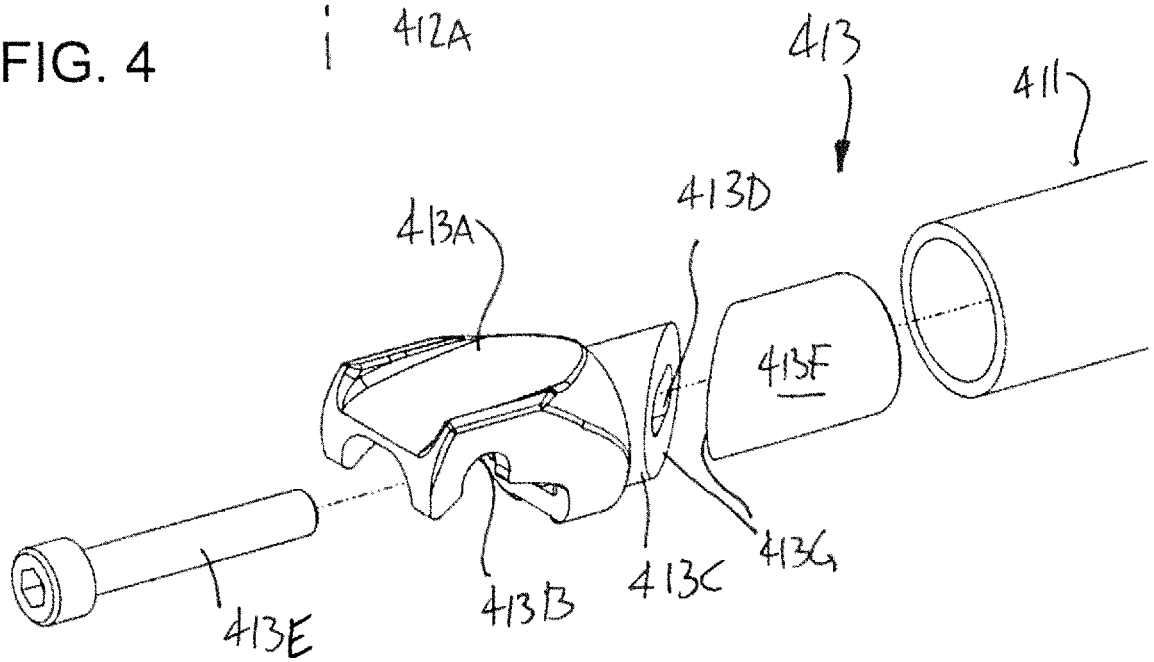
FIG. 5 is an exploded view of a hook unit of the beam assembly of FIG. 3.

Referring to FIG. 5, an exploded view of the hook unit 413 is provided. The hook unit 413 is one of numerous connection interfaces by which the beam member 411 may be releasably connected to mating clamp unit 430 or to the linkage assembly 440. Other embodiments may include a snap-fit system, with biased balls, a C-shaped clamp of resilient material, etc. The connection interface, such as hook unit 413 may be at various locations along the beam member 411 or on the linkage assembly 440 or on the seat frame 20, and may be between the second end and a carriage clamp described hereinafter for example. The hook unit 413 is mounted to the end of the beam member 411 opposite the end of the beam member 411 featuring the pivot unit 412. The hook unit 413 may have various components including a hook 413A by which the beam assembly 410 releasably connects to the mating clamp unit 430. The hook 413A may define a female slot 413B for being releasably connected to the mating clamp unit 430 in a manner described in more detail below. The female slot 413B may be a truncated circle for snuggly receiving therein a cylindrical component as explained below, but it may also be elongated to allow some play with the component is received in the female slot 413B. Alternatively, the hook 413A could have a male member for mating engagement with the mating clamp unit 430. Other coupling pairs could be used between the hook unit 413 and the mating clamp unit 430, including magnetic pairs, complementary pairs, etc.

The hook unit 413 may be connected to the beam member 411 in any appropriate way, including force fit, interference fit, set screw, adhesive. FIG. 5 shows one contemplated arrangement, with a quill 413C received in the open end of the beam member 411. As such, the quill 413C may have a circular cross-section. The quill 413C has a central bore 413D such that an expander bolt or screw 413D may extend from an exterior of the beam member 411 to an interior thereof, in which the expander bolt 413E is operatively coupled to a wedge 413F. The rotational axis of the expander bolt 413E is not normal to the plane of the surfaces 413G of the quill 413C and wedge 413F such that a screwing action will cause a slide of the wedge 413F relative to the quill 413C. The hook unit 413 may consequently be wedged into the beam member 411, by the cooperative action of the quill 413C and wedge 413F. Therefore, the position and/or orientation of the hook unit 413 at the end of the beam member 411 may be finely adjusted. This may allow a user to readily adjust the length of the beam assembly 410 to fit the wheelchair 10. A similar quill arrangement may be provided to connect the pivot unit 412 to the beam member 411. In an embodiment, only one of the pivot unit 412 and hook unit 413 has a quill assembly, as it may be required to adjust the position and/or orientation only at one end.

The pivot clamp unit 420 and the mating clamp unit 430 are now described. While the clamp units 420 and 430 are convenient in allowing an adjustment of position and/or orientation on the seat frame 20 when the footrest assembly 40 is installed, other connection units, interfaces or joints may be used as alternatives to the clamp units 420 and 430, to interface the footrest assembly 40 to the seat frame 20. For example, there may not be any clamping as other connection configurations are contemplated, depending for instance on the nature of the seat frame 20. The clamp units 420 and 430 are interfaces among others that may be used as part of the footrest assembly 40.

Referring to FIG. 4, the pivot clamp unit 420 is shown from a top point of view relative to the pivot unit 412. The pivot clamp unit 420 may have a clamp 421 by which it may be fixed to one of the tube assemblies 21 of the seat frame 20. The clamp 421 may be of the same type as the clamp 402 described above, i.e., with a bore of adjustable diameter, such that a position and orientation of the clamp 421 may be adjusted relative to the tube assembly 21, with the clamp 421 then locked into place by a set screw or the like tightening the assembly. In an embodiment, with the second portion 21B having a round cross-section, the clamp 421 and second portion 21B may form a two degree-of-freedom (DOF) joint—a cylindrical joint—, with a rotational DOF about a central axis of the second portion 21B, and a translation in a direction parallel to the central axis of the second portion 21B. The pivot clamp unit 420 may be mounted in other ways to the seat frame 20, such as at a bottom open end of the tube assembly 21 (a male portion received in the tube assembly 21, indexed holes in the tube assembly 21, etc.). The pivot clamp unit 420 may also be an integral part of the tube assembly 21.

A U-shaped bracket 422 projects from the clamp 421 and supports the pivot 412A. Accordingly, the pivot unit 412 may rotate about axis Y2 via the pivot 412A. In an embodiment, one or more wave washers (or curved washers) 423 are located on the pivot 412A, between the bracket 422 and the pivot unit 412. The washers 423 apply some biasing force therebetween, which biasing force may be of sufficient magnitude to be felt by a user during the folding or deployment of the wheelchair 10. The footrest assembly 40 may be without the washer(s) 423.

Figure 6:
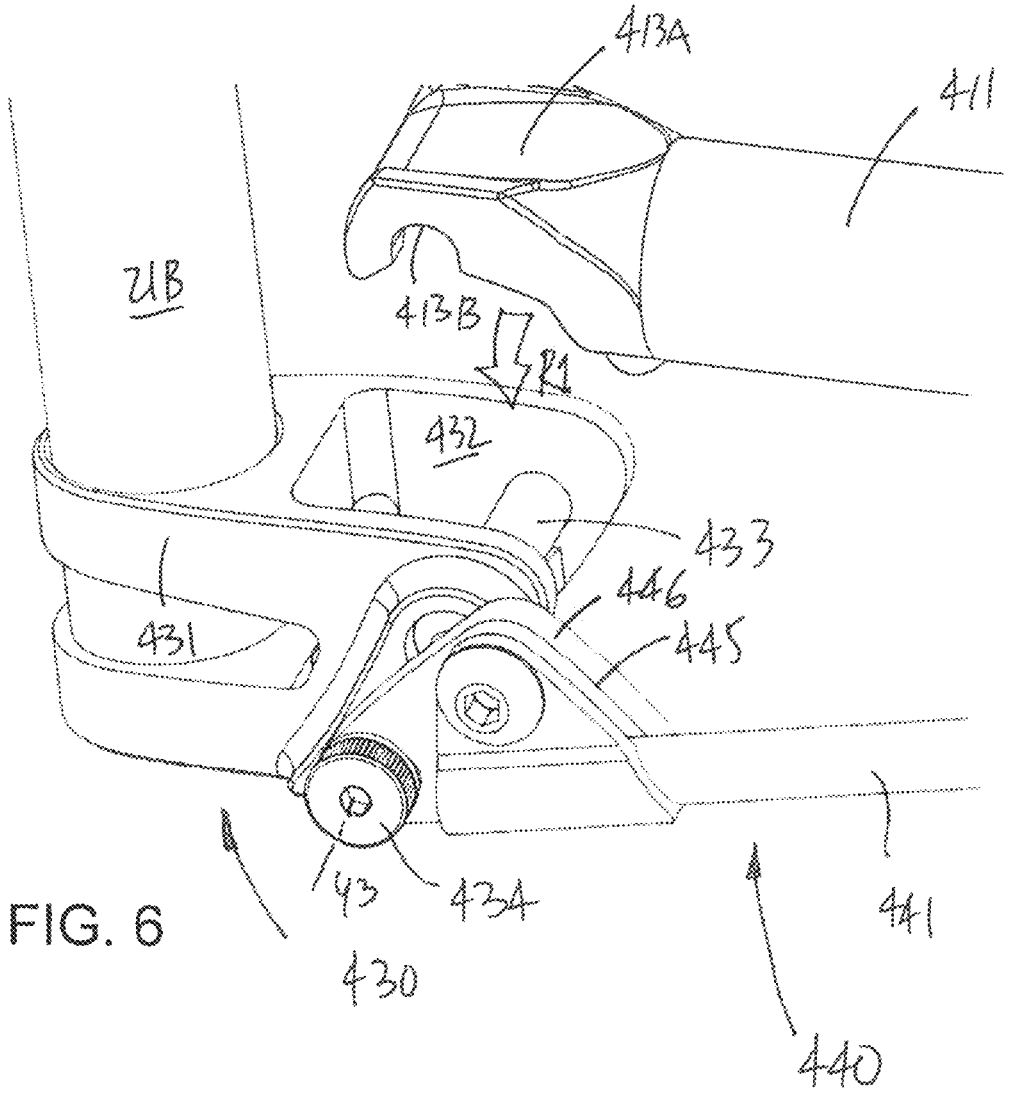
FIG. 6 is a perspective view of the hook unit in directing for mating with a mating clamp unit, in accordance with the present disclosure.
Figure 7:
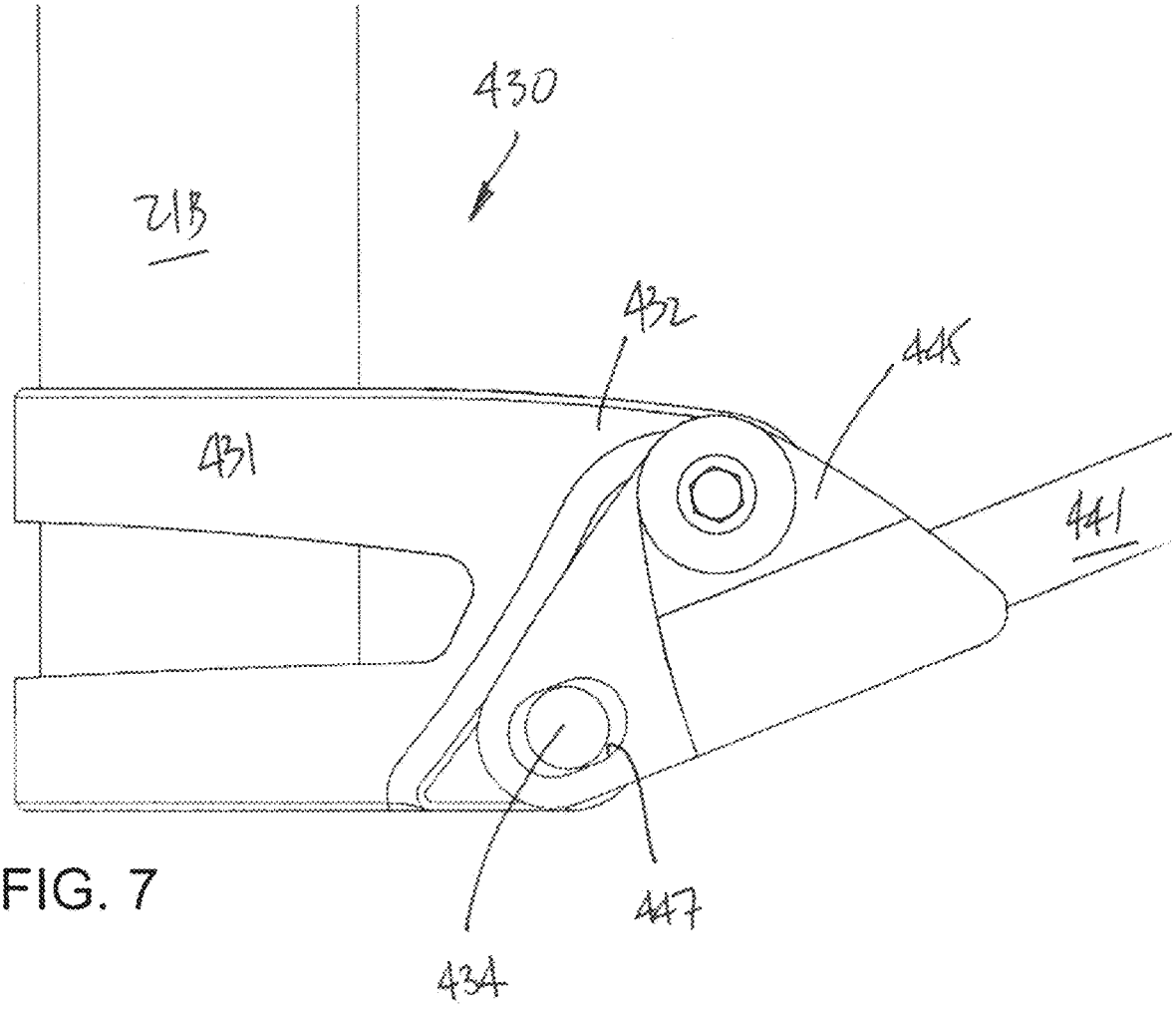
FIG. 7 is an elevation view of the mating clamp unit, in accordance with the present disclosure.

Referring to FIGS. 6 and 7, the mating clamp unit 430 is on the other side of the wheelchair 10. The mating clamp unit 430 may also have one or more clamps 431 (two shown in FIG. 6) by which it may be fixed to the other of the tube assemblies 21 of the seat frame 20. The clamp 431 may be of the same type as the clamps 402 and 421 described above, such that a position and orientation of the clamp 431 may be adjusted relative to the tube assembly 21, with the clamp 431 then locked into place by a set screw or the like (two independent set screws may be present for the double clamps 431). In an embodiment, with the second portion 21B having a round cross-section, the clamp 431 and second portion 21B may form a two DOF joint—a cylindrical joint—, with a rotational DOF about a central axis of the second portion 21B, and a translation in a direction parallel to the central axis of the second portion 21B. The mating clamp unit 430 may also be mounted in other ways to the seat frame 20, such as at a bottom open end of the tube assembly 21, etc., e.g., manners described for the pivot clamp unit 420. The mating clamp unit 430 may also be an integral part of the tube assembly 21 as well.

The mating clamp unit 430 may also have a U-shaped bracket 432 projecting from the clamp 431, to support the ends of pin 433. Accordingly, the pin 433 has an elongated axis. The pin 433 is the male connector that will be matingly received in the female slot 413B of the hook unit 413. The pin 433 is therefore sized for snug engagement with the female slot 413B, for instance with some resistance against the release of one from the other once matingly engaged. However, if the female slot 413B is elongated as opposed to being circular, the female slot 413B may receive the pin 433 with some play. As the beam assembly 410 rotates in the direction shown by R1 in FIG. 6, the pin 433 is one example of a male connector, and is located in the path of the hook unit 413 to matingly engage with the female slot 413B, another example among possible female connectors. The pin 433 may be a bolt with nut, etc, in similar fashion to the pivot 412A. A connector 434 is provided on one side of the bracket 432. The connector 434 may be a set screw, a bolt, etc. The connector 434 serves as interface for the linkage assembly 440, and may allow pivoting motion of the linkage assembly 440 relative to the mating clamp unit 430. The connector 434 is located below the pin 433 may or may not extend from side to side of the U-shaped bracket 432.

Figure 8:
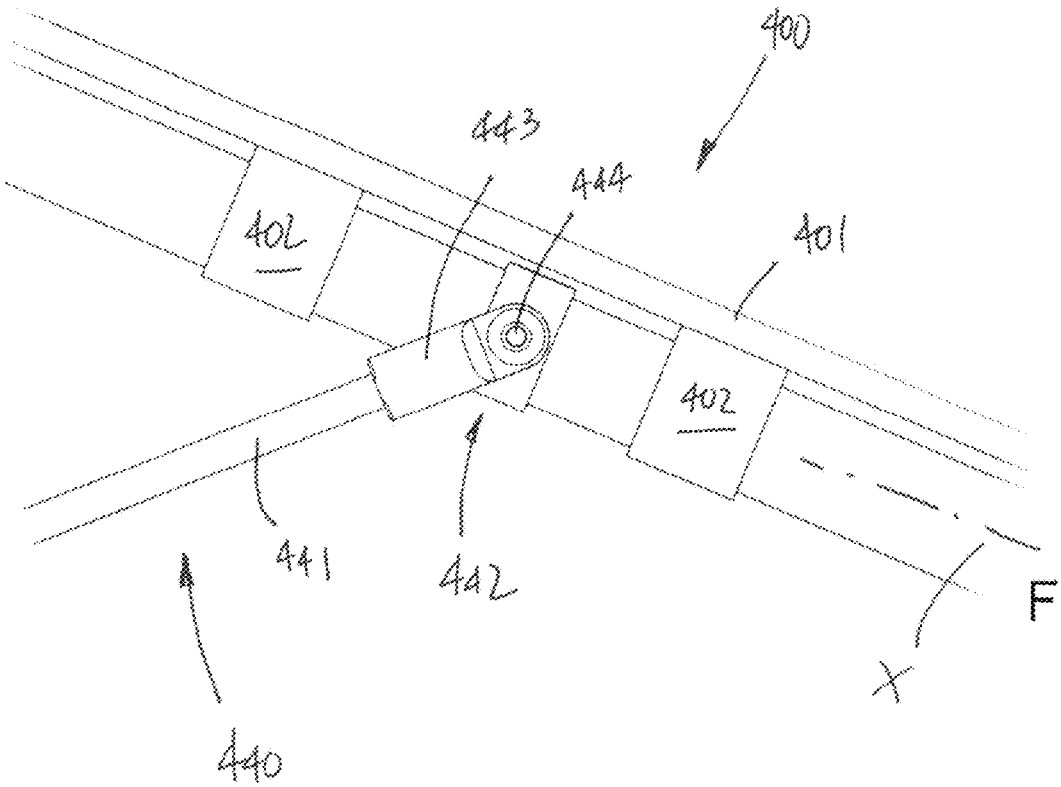
FIG. 8 is a perspective view of an interface between a linkage assembly and the beam assembly in accordance with the present disclosure.

Referring to FIGS. 3 and 6-8, the linkage assembly 440 has a rod member 441. The rod member 441 may be a rigid rod, such as a metal, plastic or composite rod. It may be a tube as well. In an embodiment, the rod member 441 has a smaller diameter than the beam member 411. A carriage clamp 442 of the linkage assembly 440 is secured to the beam member 411. The carriage clamp 442 may be of the same type as the clamps 402, 421 and 431 described above, such that a position and/or orientation of the carriage clamp 442 may be adjusted relative to the beam member 411, with the carriage clamp 442 then locked into place by a set screw 442A or the like. The carriage clamp 442 may hence form a central cylindrical joint with the beam member 411. The rod member 441 may be pivoted to the beam member 411 in other ways, such as by a through pivot received in a pivot hole in the beam member 411. In an embodiment, the carriage clamp 442 is convenient as it allows position and/or orientation adjustment. According to an embodiment, the carriage clamp 442 may lie over a center point of the beam member 411. Moreover, as shown in FIG. 8, the carriage clamp 442 may be lodged between the clamps 402 of the footplate 400. Hence, the spacing between the clamps 402 may be determined as a function of the presence of the carriage clamp 442. A nipple 443 is mounted to the side of the carriage clamp 442 and is held by a pivot 444, in such a way that the nipple 443 may rotate relative to the carriage clamp 442, along axis Y4, with axis Y4 being generally parallel to axis Y2 when projected onto a horizontal plane.

The rod member 441 has a first end received in the nipple 443, whereby the rod member 441 is in a rotational relation with the carriage clamp 442. The rod member 441 and nipple 443 may be screwed to one another, force fitted together, integral, etc. The nipple 443 could also be entered into a hollow end of the rod member 441 according to another embodiment. In an embodiment, the nipple 443 acts a female component of a male-female connector, though it may also be a male component.

The linkage assembly 440 may have another clamp at the other end of the rod member 441, such as in the form of a clip 445. The clip 445 may operate under the same principle as the previously described clamps (passage of variable size), such that a position and orientation of the clip 445 may be adjusted relative to the rod member 441, with the clip 445 then locked into place by a set screw 445A or the like. The orientation of the clip 445, with its passage parallel to the rod member 441, is such that the positon of the clip 445 along the rod member 441 does not impose a precise length constraint to the rod member 441.

A tab 446 may extend from clip 445. The tab 446 may define a hole 447, for receiving the connector 434 of the mating clamp unit 430 therein. According to an embodiment, the hole 447 may be elongated in shape as shown in FIG. 7, to allow some play during the folding/deployment of the wheelchair 10. The tab 446 and connector 434 thereby form a rotational joint about an axis Y3, that may also allow some translational movement in one particular embodiment. The axis Y3 may be generally parallel to axes Y2 and Y4 when all are projected onto a horizontal plane.

To summarize, the footrest assembly 40 and its components, i.e., the beam assembly 410, the pivot clamp unit 420 and the mating clamp unit 430 (or like frame interfaces), and the linkage assembly 440, form a foldable mechanism with numerous DOF joints. For example, when assembled and ready for use, the beam assembly 410 and the linkage assembly 440 have a rotational DOF joint therebetween, about axis Y4. In an embodiment, another rotational DOF joint and a translation DOF joint may also be present, respectively about the X axis and in a direction parallel to the X axis of the beam member 411, with these other DOF joints being lockable by the carriage clamp 442 or like interface component. The interface between the beam assembly 410 and the seat frame 20, shown in an embodiment as the pivot clamp unit 420, provides one rotational DOF joint (about axis Y2). The pivot clamp unit 420 may also define another rotational DOF joint and a translation DOF joint about or in a direction parallel to an axis of the tube assembly 21, these additional DOF joints being lockable by the clamping of the pivot clamp unit 420. Accordingly, if the second portions 21B on opposite sides of the frame 20 are not parallel to one another, the configuration of the clamps 421 and 431 allows an installation of the footrest assembly 40 to the seat frame 20. Finally, the interface between the linkage assembly 440 and the seat frame 20, shown in an embodiment as the mating clamp unit 430, has a rotational DOF joint about axis Y3. There may also be translational DOF joint if the hole 447 has the form of an elongated slot, though such translational DOF joint provides a limited range of movement. The mating clamp unit 430 may also define another rotational DOF joint and a translation DOF joint about or in a direction parallel to an axis of the tube assembly 21, these additional DOF joints being lockable by the clamping of the mating clamp unit 430. The rod member 441 may also be in a lockable translational DOF joint relation with the clip 445. Once assembled in the manner shown in FIG. 3, the total number of DOFs may be reduced by the constraints concurrently imposed by the components of the footrest assembly 40.

The invention claimed is:

1. A footrest assembly for a wheelchair having a structure expandable from a contracted condition to an expanded position, the footrest assembly comprising:

a beam assembly having a structural member having a first end and a second end, a first joint with at least one rotational degree of freedom adapted to interface the first end of the structural member to a first side of a frame of the wheelchair, a linkage assembly connected to the structural member by a central joint with at least a rotational degree of freedom and a lockable translational degree of freedom joint, a second joint with at least one rotational degree of freedom adapted to interface the linkage assembly to a second side of the frame of the wheelchair, and a connector interface releasably engaging the beam assembly to the linkage assembly and/or to the second joint when the wheelchair is deployed for use.

2. The footrest assembly according to claim 1, wherein a rotational axis of the central joint is higher than a rotational axis of the first joint and of the second joint relative to a ground when the wheelchair is deployed for use.

3. The footrest assembly according to claim 1, wherein projections on a horizontal plane of the rotational axis of each of the first joint, the central joint and the second joint are parallel to one another.

4. The footrest assembly according to claim 1, wherein the connector interface includes a hook unit at or adjacent to the second end of the structural member.

5. The footrest assembly according to claim 4, wherein the structural member is a tube, and the hook unit has a quill and wedge assembly to be secured inside the second end of the tube.

6. The footrest assembly according to claim 1, wherein the first joint is part of a pivot clamp unit having a clamp configured to be connected to the first side of the frame of the wheelchair.

7. The footrest assembly according to claim 6, wherein the clamp forms a cylindrical joint with the first side of the frame.

8. The footrest assembly according to claim 1, wherein the second joint is part of a mating clamp unit having a clamp configured to be connected to the second side of the frame of the wheelchair.

9. The footrest assembly according to claim 8, wherein the clamp forms a cylindrical joint with the second side of the frame.

10. The footrest assembly according to claim 8, wherein the mating clamp unit has a male member of the connector interface, for mating engagement with a female member of the connector interface on the structural member.

11. The footrest assembly according to claim 1, wherein the central joint is part of a carriage clamp connected to the structural member.

12. The footrest assembly according to claim 11, wherein the carriage clamp forms a cylindrical joint with the structural member, the cylindrical joint including the lockable translational degree of freedom joint and a lockable rotational degree of freedom joint about a longitudinal axis of the structural member.

13. The footrest assembly according to claim 1, wherein the beam assembly includes a footplate.

14. The footrest assembly according to claim 13, wherein the footplate is connected to the structural member by at least one clamp forming a lockable cylindrical joint with the structural member.

15. A footrest assembly for a wheelchair of the typo having a structure expandable from a contracted condition to an expanded position, the footrest assembly comprising:

a beam assembly having a structural member having a first end and a second end, a pivot clamp unit including a first joint with at least one rotational degree of freedom adapted to interface the first end of the structural member to a first side of a frame of the wheelchair, and a first clamp forming a cylindrical joint with the first side of the frame, a linkage assembly connected to the structural member by a central joint with at least a rotational degree of freedom, a mating clamp unit including a second joint with at least one rotational degree of freedom adapted to interface the linkage assembly to a second side of the frame of the wheelchair, and a second clamp forming a cylindrical joint with the second side of the frame, and a connector interface releasably engaging the beam assembly to the linkage assembly and/or to the mating clamp unit when the wheelchair is deployed for use.

16. The footrest assembly according to claim 15, wherein a rotational axis of the central joint is higher than a rotational axis of the first joint and of the second joint relative to a ground when the wheelchair is deployed for use.

17. The footrest assembly according to claim 15, wherein projections on a horizontal plane of the rotational axis of each of the first joint, the central joint and the second joint are parallel to one another.

18. The footrest assembly according to claim 15, wherein the connector interface includes a hook unit at or adjacent to the second end of the structural member.

19. The footrest assembly according to claim 15, wherein the central joint is part of a carriage clamp connected to the structural member.

20. The footrest assembly according to claim 15, wherein the beam assembly includes a footplate.

* * * * *